United States Patent [19]

Grayson et al.

[11] Patent Number: 4,952,098

[45] Date of Patent: Aug. 28, 1990

[54] RETAINING WALL ANCHOR SYSTEM

[75] Inventors: Boyd H. Grayson, Lakeland; Richard J. Beak, Tampa, both of Fla.

[73] Assignee: Ivy Steel Products, Inc., Tampa, Fla.

[21] Appl. No.: 454,711

[22] Filed: Dec. 21, 1989

[51] Int. Cl.[5] ..... E02D 5/00; E02D 29/02

[52] U.S. Cl. ..... 405/262; 405/258; 405/284

[58] Field of Search ..... 405/258, 262, 287, 286, 405/285, 284; 403/209, 397; 256/12.5

[56] References Cited

U.S. PATENT DOCUMENTS

| | | | |
|---|---|---|---|
| 4,324,508 | 4/1982 | Hilfiker et al. | 405/258 X |
| 4,329,089 | 5/1982 | Hilfiker et al. | 405/262 |
| 4,337,004 | 6/1982 | Mundell et al. | 403/209 |
| 4,725,170 | 2/1988 | Davis | 405/286 |

FOREIGN PATENT DOCUMENTS

| | | | |
|---|---|---|---|
| 0163283 | 3/1980 | Netherlands | 405/284 |
| 0606641 | 11/1978 | Switzerland | 405/284 |
| 0621174 | 1/1981 | Switzerland | 405/284 |

*Primary Examiner*—Dennis L. Taylor
*Attorney, Agent, or Firm*—Pettis & McDonald

[57] ABSTRACT

A retaining wall anchor system of the type primarily used to tie retaining walls to dead men. The anchor system comprises at least one wall anchor formed of a pair of spaced apart legs joined at one end to form a U-shaped portion while the other ends are attached to the retaining wall, such that the U-shaped portion extends from the wall. At least one tie rod which has one end attached to a dead man and the other end has a loop formed thereon by bending the end back toward the other end of the tie rod, around, toward and past the tie rod, so that the tie rod end extends beyond the tie rod. The tie rod is inserted between the spaced apart legs of the wall anchor, and a locking device is removably inserted through the tie rod loop such that the tie rod is attached to the wall anchor.

8 Claims, 2 Drawing Sheets

RETAINING WALL ANCHOR SYSTEM

BACKGROUND OF THE INVENTION

1. Field Of The Invention.

The present invention relates to retained earth structures in general and in particular to a retaining wall anchor system wherein tie rods or wire grid soil retention systems may be attached to retaining walls.

2. Description Of The Prior Art.

Retaining wall systems for soil retention have been in use for a great number of years increasing in complexity from simple beams, to concrete walls, wire mesh systems and prefabricated wall systems. Due to the forces of the earth pressing against the retaining walls, it is necessary to utilize anchoring systems to prevent overturning of the walls or other similar failures. Anchoring systems have evolved from simple bars bolted through the retaining walls to more complex wire mesh dead men interlocking with anchors embedded within the concrete retaining walls.

U.S. Pat. No. 569,995 issued to H. P. Boyd and U.S. Pat. No. 1,772,174 issued to F. E. Anderson are of interest as they disclose a means for making end to end connections of tie rods. These inventions utilize a threaded device which is expensive to manufacture and time consuming to install.

A number of patents disclose the use of threaded nuts and bolts to connect the tie rods to the retaining walls and frequently threaded nuts and bolts are used to connect the tie rods to dead men: specifically, the patents issued to Mason, U.S. Pat. No. Re.28,977; King, U.S. Pat. No. 2,902,743; Johnson, et al., U.S. Pat. No. 4,189,891; Hilfiker, U.S. Pat. No. 4,260,296; and Vilcinskas, U.S. Pat. No. 4,303,355. Bolted systems are expensive to make and are time consuming to install; they also require holes to be made through the wall and often through the dead men.

U.S. Pat. No. 2,152,816 discloses a fence in which bolts are similarly passed through the fence post and then the fence material is hooked to the ends of the bolts.

A patent issued to Hilfiker, et al., U.S. Pat. No. 4,329,089, and a patent issued to Broadbent, U.S. Pat. No. 4,470,728 both disclose a complex system in which anchors wrap around portions of the retaining wall and/or the retaining wall reinforcement steel. These anchors are then connected to the dead men systems by placing the end wires of the dead men over open hooks attached to the anchors or by bolting the rods to the anchors. These anchor systems are complex and expensive to install.

Three patents issued to Vidal, U.S. Pat. Nos. 3,686,873, 4,045,965 and 4,116,010 disclose anchors protruding from the retaining walls to which tie rods or anchoring straps are connected. In these patents, anchors are embedded within the walls or the wall panels and the tie rods are bolted to that portion of the anchors protruding from the wall. The use of bolts to make the tie rod connections is expensive and the installation is time consuming.

U.S. Pat. No. 4,449,857 issued to Davis discloses a system which includes a threaded anchor buried within a retaining wall and a threaded bolt which has been mounted on mesh soil reinforcement panels, a type of dead man. The threaded bolt must be screwed into the anchor to make the appropriate connection. This system is expensive to manufacture and time consuming to install.

U.S. Pat. No. 4,324,508 issued to Hilfiker, et al. discloses a U-shaped anchor embedded within a retaining wall in which the U-shaped portion extends exposed from the wall. The end wires of the soil reinforcement panels are passed through the anchors and are hand twisted or wrapped about the anchor to securely fasten the soil reinforced panels (dead men) to the retaining wall. The hand twisting is labor intensive.

U.S. Pat. No. 4,725,170 to Davis discloses a clevis member embedded into a wall panel having two welded loop ends protruding from the wall surface and a tie rod having a welded loop end which is placed between the clevis' looped ends. A bolt or rod is passed through all three loops to complete the connection. Such welded connections are expensive to manufacture.

It has been pointed out that the prior art is either so complex that it is expensive to make; requires threaded attachments which are expensive to make and time consuming to install or lastly, requires a considerable amount of welding which increases the costs of manufacture. Therefore, it remains clear that there is a need for a retaining wall anchor system that is simple to manufacture, easy to install and that does not require either welded or threaded connectors.

SUMMARY OF THE INVENTION

The present invention provides an anchor system which is inexpensive to manufacture and quick and easy to install for connecting a retaining wall to a dead man.

Most simply stated, the anchor system comprises at least one wall anchor attached to a retaining wall; at least one tie rod, which at one end is removably fastened to the wall anchor and at the other end is attached to a dead man; and a locking means which removably fastens the tie rod to the wall anchor.

The wall anchor comprises a pair of spaced apart legs joined at one end to form a U-shaped portion while the free ends are attached to the retaining wall. A loop is formed on the end of the tie rod which is to be attached to the wall anchor. The loop configuration is attained by bending the end of the rod backward toward its other end and then around, toward and beyond the tie rod.

The legs of the anchor are so spaced and the loop on the tie rod is so dimensioned and configured that the loop may be inserted between the anchor legs. By inserting a locking device through the loop of the tie rod after it is inserted between the legs of the wall anchor, the tie rod is removably attached to the wall anchor.

The application of a longitudinal force along the axis of the tie rod forces the loop of the tie rod against the U-shaped portion of the anchor tightening the loop about the locking device.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
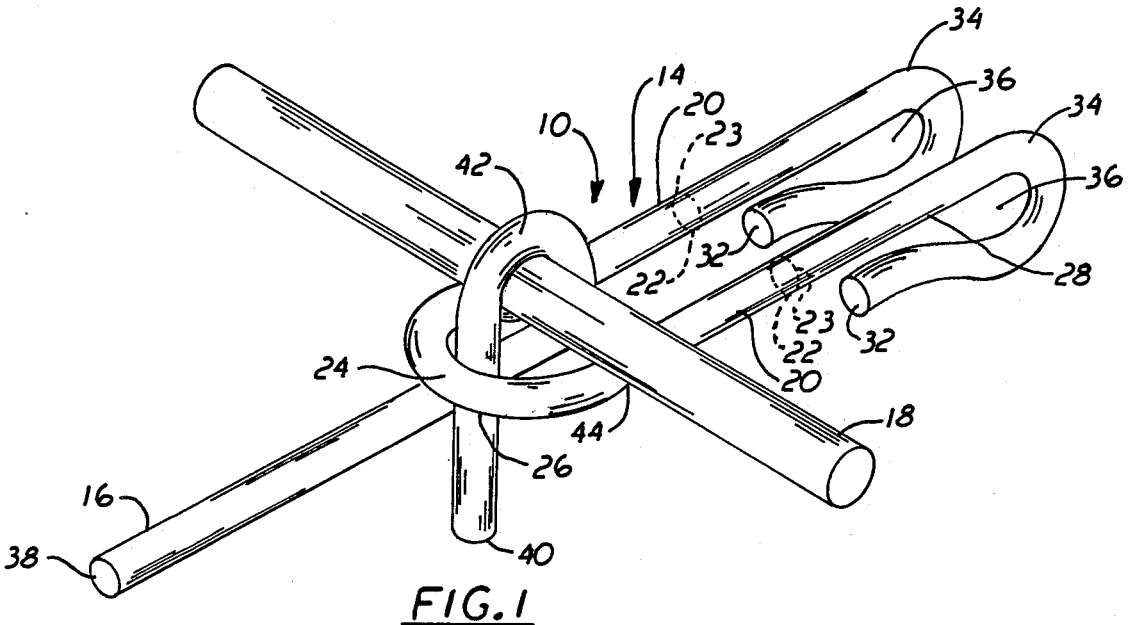
FIG. 1 is an isometric view of the anchor system.
Figure 2:
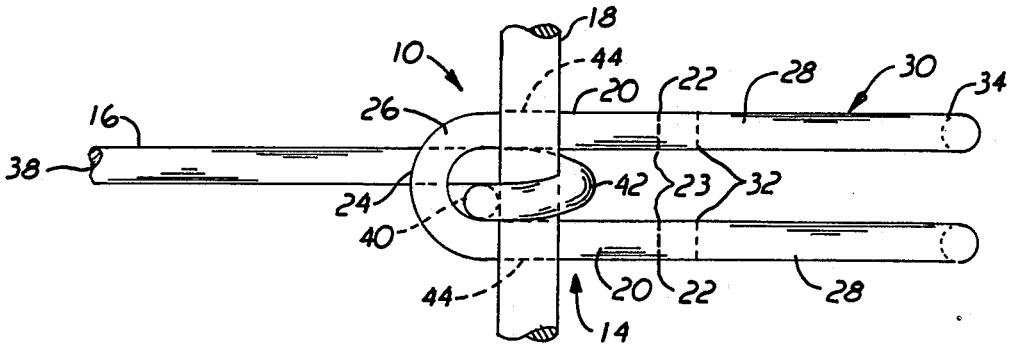
FIG. 2 is a top plan view of the anchor system.
Figure 3:
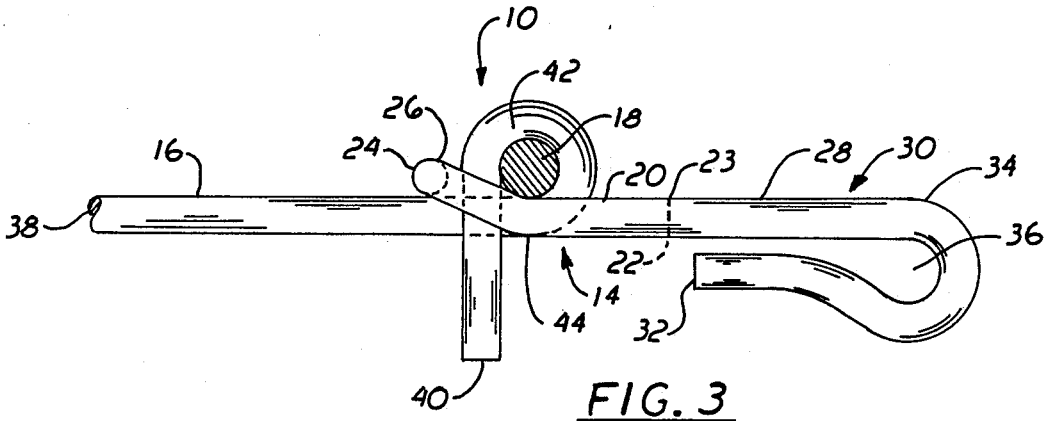
FIG. 3 is a side elevation of the anchor system.

A preferred embodiment of the retaining wall anchor system is illustrated in the drawing figures. The anchor system is generally indicated as 10 in the views of FIGS. 1–6 and the retaining wall is shown generally as 12 in FIGS. 4, 5 and 6. Referring first to FIGS. 1, 2 and 3, it can be seen that the anchor system 10 comprises a wall anchor shown generally as 14, a wall attachment shown generally as 30, a tie rod 16 and a locking device 18.

The wall anchor 14 is comprised of two generally parallel legs 20, each having a first end 22 and a second end 24. The second ends 24 are joined together to define a substantially U-shaped portion 26. While in the preferred embodiment, the legs are shown substantially parallel, it can be easily seen that the legs may have a very large angular relationship one to another and still provide a working relationship with the tie rod 16 and the locking device 18. It can also be seen that the legs 20 of the wall anchor 14 may be attached to the wall by many conventional means, including, but not limited to, welding them to plates set in the wall, welding them to the walls' rebar, etc. However, in the preferred embodiment, the first ends 22 of the legs 20 of the wall anchor 14 are integrally joined to the wall attachment portion shown generally as 30.

The wall attachment portion 30 comprises two spaced apart arms 28, each having two ends, one of the ends 23 being joined integrally with a corresponding end 22 of leg 20 of the wall anchor 14 and the other ends 32 of the arms 28 remaining free. The arms 28 are bent at a point 34 between the free ends 32 and the joined ends 23 of the arms 28. The bend 34 may be at almost any angle; however, in the preferred embodiment, the ends 32 of the arms 28 may be bent at the point 34 downward and backward toward the first ends 23 of the arms 28 creating an open eye 36.

In the preferred embodiment, the legs 20 of the wall anchor 14 are bent upward at a point 44 such that a plane containing the U-shaped portion 26 lies at an angle to the plane containing the legs 20. In the preferred embodiment, this angle is generally between 30° and 45°, however, the angle may be permitted to vary to any convenient angle.

Figure 6:
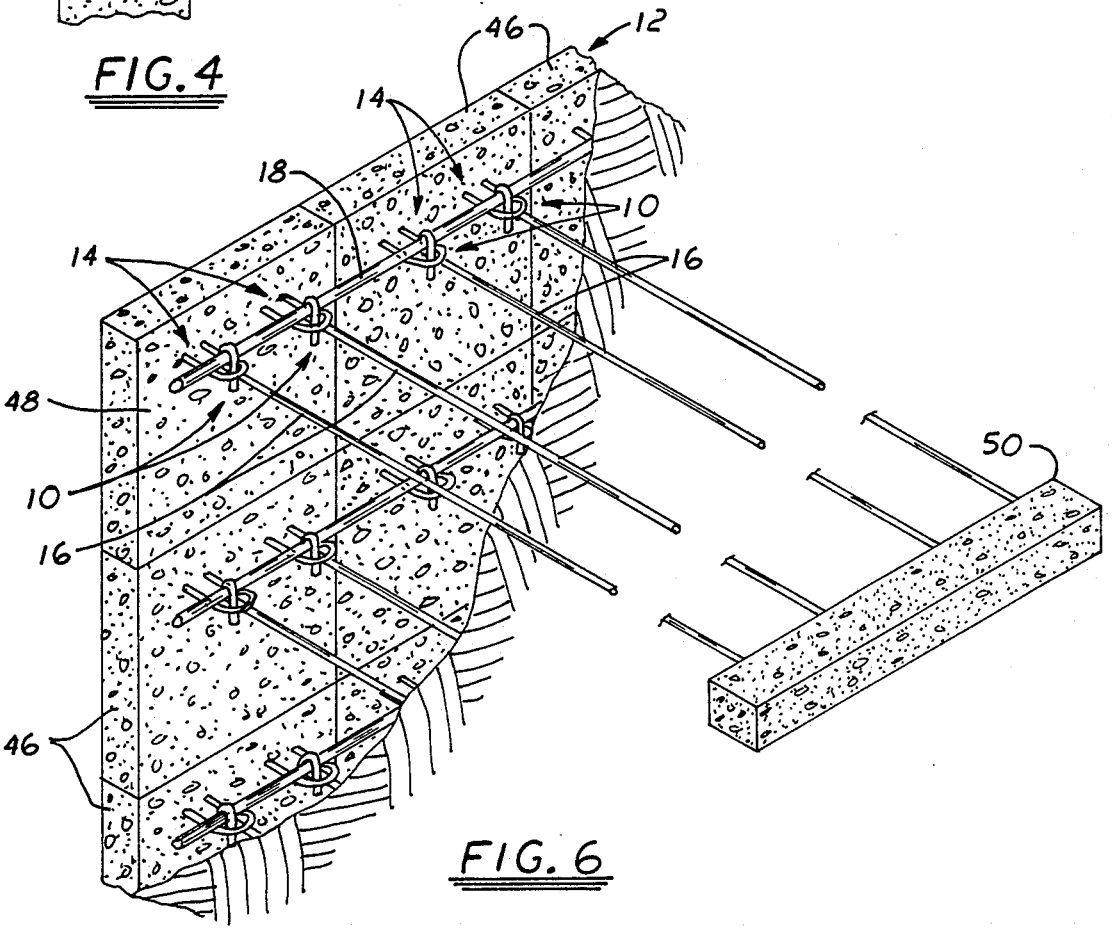
FIG. 6 is a perspective view illustrating the anchor system attached to a modular retaining wall system.

As best illustrated in FIG. 1, the tie rod 16 has a first end 38 which is attached to a dead man 50 shown in FIG. 6 as a typical dead man structure well known to those skilled in the art, and for which other types of dead man may be substituted, and a second end 40. The second end 40 is formed into a loop 42 by bending the second end 40 of the tie rod 16 towards the first end 38 of the tie rod 16 and then downward past the tie rod 16 until it extends beyond the tie rod 16.

Figure 4:
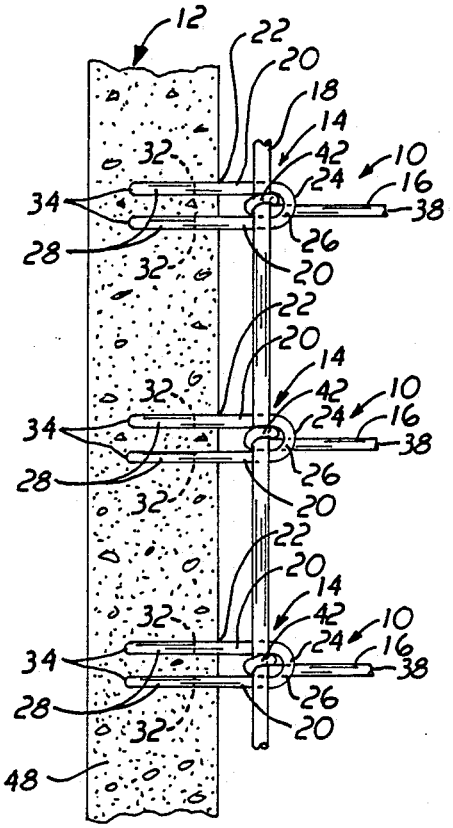
FIG. 4 is a top plan view of the anchor system illustrating the anchors embedded within a retaining wall.
Figure 5:
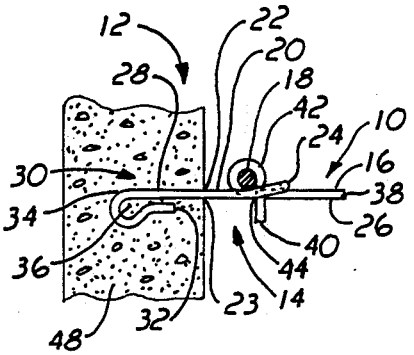
FIG. 5 is a side elevation illustrating an anchor embedded within a retaining wall.

The locking means 18 in the preferred embodiment is a rod which is inserted through the loop 42 of the tie rod 16 after the loop 42 of the tie rod 16 has been inserted between the legs 20 of the wall anchor 14. The spacing of the legs 20 of the tie rod 16 must be dimensioned such that the loop 42 of the tie rod 16 may be inserted between the legs 20. It can be seen that by applying a longitudinal force along the axis of the tie rod 16, the loop 42 of the tie rod 16 will be forced against the U-shaped portion 26 causing the loop 42 to tighten around the locking device 18. In the preferred embodiment, the locking device is a simple rod which may be a part of a larger system as shown in FIG. 4 and FIG. 6. In a situation where the wall anchors are generally used alone, the locking device 18 may be a bolt and nut, a tie, or any similarly well known connecting means.

The anchor system 10 in the preferred embodiment is manufactured from cold drawn steel wire which is then galvanized. The wire is sized according to the stresses within the wall system and the loads on the individual parts of the anchor system 10. These stresses and forces are calculated by standard engineering practices utilizing the spacing of the wall anchors 14, the forces being applied against the retaining wall, etc. The dead men may be a wire mesh system buried behind the retaining wall, blocks of concrete sized to provide adequate resistance, pilings or any other conventional construction.

Having thus set forth a preferred construction for the anchor system 10 of this invention, it is to be remembered that this is but a preferred embodiment. Attention is now invited to a description of the use of the anchor system 10. Often it is necessary to build retaining walls to entrap soils and other materials to prevent them from shifting. Such retaining walls have been constructed of concrete block, solid concrete walls or as shown in FIG. 6, walls constructed from pre-cast concrete panels. These panels may be formed of any one of a number of different shapes and sizes, but are shown in FIG. 6 as generally rectangular blocks.

During the fabrication of the walls or the concrete blocks 46, wall anchors 14 are attached to the walls by inserting the wall attachment portion 30 within the forms in which the concrete 48 is to be poured. Once the blocks 46 have been sufficiently cured and placed into a wall configuration as shown in FIG. 6, the loops 42 of the tie rods 16 may be inserted between the legs of the wall anchor 14 so that the locking device 18 may then be slid through the loops 42 of the tie rods 16 as shown in FIG. 6. The ends of the locking device 18 may be bent at approximately right angles to prevent them from becoming disengaged from the wall anchors 14. To prevent disengagement of the locking device, other conventional means may be used including, but not limited to, pins, bolts, etc. The tie rods 16 may be an integral part of a pre-formed wire mesh dead man or other conventional dead man systems. The installation of this system requires no field welding or use of threaded connectors, which makes the installation efficient and quickly accomplished.

It will thus be seen that the objects set forth above among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween:

Now that the invention has been described,

What is claimed is:

1. A retaining wall anchor system of the type primarily intended for use in combination with a retaining wall and a dead man, said system comprising:

at least one wall anchor, said wall anchor comprising a pair of spaced apart legs, each of said legs having a first end and a second end, said second ends being joined one to the other such that said legs define a substantially U-shaped portion, and said first ends being attached to the retaining wall, such that said joined second ends extend therefrom;

at least one tie rod having a first end and a second end, said first end being attached to the dead man, and said second end being formed into a loop defined by bending said second end towards said first end of said tie rod, then around, toward, and past said tie rod such that said second end extends beyond said tie rod, said loop being dimensioned and configured to be insertable between said legs of said wall anchor intermediate the wall and said joined first ends of said wall anchor so that said loop is located to one side of said legs and said second end is located to the opposite side of said legs; and locking means removably insertable through said loop of said tie rod after said loop has been inserted between said legs of said wall anchor such that said tie rod may be attached to said wall anchor.

2. A retaining wall anchor system as in claim 1 wherein said legs are substantially parallel to each other.

3. A retaining wall anchor system as in claim 1 wherein said wall anchor further comprises a bend formed in said pair of legs of said wall anchor intermediate the wall and said horizontal U-shaped portion, such that a plane containing said U-shaped portion of said legs is at an angle to a plane containing said legs between the wall and said bend in said legs.

4. A retaining wall anchor system as in claim 1 wherein said locking means comprises a rod inserted through said loop of said tie rod after said loop has been inserted between said legs of said wall anchor such that said rod may be attached to said wall anchor.

5. A retaining wall anchor system as in claim 1 wherein said wall anchor further comprises a wall attachment means joined to said first ends of said legs of said wall anchor and attached to the retaining wall.

6. A retaining wall anchor system as in claim 5 wherein said wall anchor further comprises a wall attachment means joined to said first ends of said legs of said wall anchor and extending inwardly within the retaining wall.

7. A retaining wall anchor system as in claim 6 wherein said wall attachment means comprises a pair of spaced apart arms each of said arms having two ends, one of said ends joined integrally end to end to a corresponding first end of said anchor legs, the other ends of said arms remaining free and extending into the wall, said arms having a bend intermediate said free ends and said joined ends.

8. A retaining wall anchor system as in claim 7 wherein said bends define a pair of open eyes by bending said free ends toward said joined ends such that said arms adjacent to said free ends are generally parallel to said arms adjacent to said joined ends.

* * * * *